US005690236A

United States Patent [19]

Galilea

[11] Patent Number: 5,690,236

[45] Date of Patent: Nov. 25, 1997

[54] VALET

[76] Inventor: Jaime Galilea, Napoleon 3037 Dep 31, Santiago, Chile

[21] Appl. No.: 668,249

[22] Filed: Jun. 20, 1996

[51] Int. Cl.[6] ..... A47F 5/00

[52] U.S. Cl. ..... 211/104; 211/1.3; 211/94.5; 223/94

[58] Field of Search ..... 211/1.3, 94, 94.5, 211/86, 87, 104, 99, 118; 223/89, 94

[56] References Cited

U.S. PATENT DOCUMENTS

| | | | |
|---|---|---|---|
| 1,058,394 | 4/1913 | Wahl | 223/94 |
| 1,530,848 | 3/1925 | Moore | 211/94.5 |
| 1,545,765 | 7/1925 | Harold | 223/94 |
| 2,569,761 | 10/1951 | Hibbs | 211/1.3 X |
| 3,214,032 | 10/1965 | Hightower | 211/104 X |
| 3,542,170 | 11/1970 | Biaio | 211/94 X |

*Primary Examiner*—Robert W. Gibson, Jr.
*Attorney, Agent, or Firm*—Emmanuel J. Lobato; Burns & Lobato, P.C.

[57] ABSTRACT

A valet constructed as a case having a top, sides and an open bottom. The case houses a sliding drawer having a front panel, sides constructed as frame slidable on support guides interiorly of the sidewalls of the case and also has an open bottom. A clothes hanger is pivotally mounted on a rod inside the drawer extending from one side to the other near the front panel. The hanger is pivotable upwardly into the drawer and held housed in the drawer by a bridge member disposed spanning the open bottom of the case so that the hanger rests slidable thereon and retained within the drawer when closed and can slide clear of the bridge member and depend downwardly when the drawer is opened for hanging clothing. The hanger has arms with end portions pivotal for folding toward the respective arms for housing of the hanger in the drawer and when the hanger is depending from the drawer the end portions are pivotable for forming fixed arm extensions when the drawer is open and for hanging clothing the front panel is spaced from the case sufficiently that trousers or other clothing can be draped over the upper edge of the front panel. The valet case can be placed on top of a piece of furniture or mounted on top of a wall-hung shelf or on an underside thereof.

10 Claims, 6 Drawing Sheets

Fig. 7
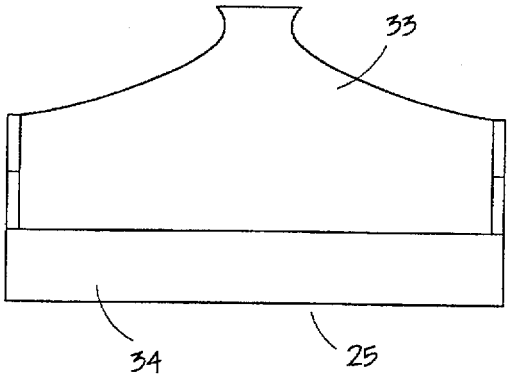
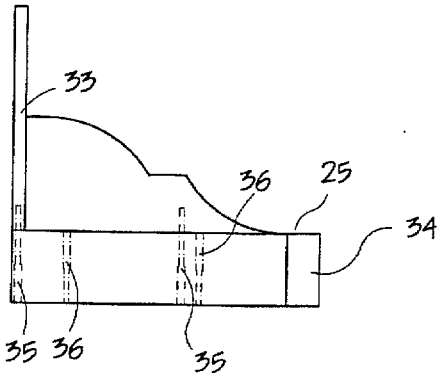
Fig. 8
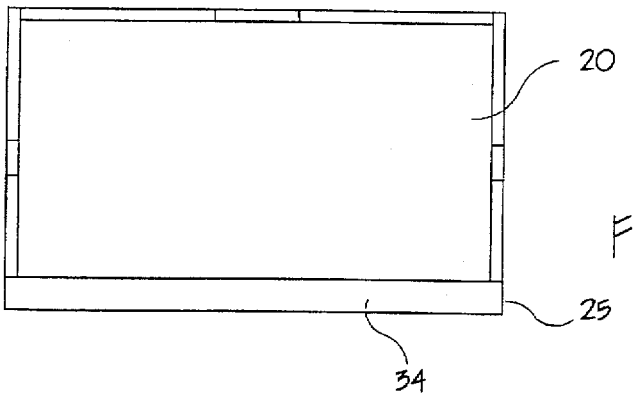
Fig. 9

VALET

BACKGROUND OF THE INVENTION

Two types of valets are known and are normally available in the market. One is a stand or rack consisting of a structure comprising two legs related to a floor plate or base and having a shoulder-shaped frame opposite to the base for draping and hanging an article of clothing when not in use; wherein the hanger portion has the hook piece replaced by an horizontal bar over which trousers can be hung. This valet is the best known and presents two important drawbacks, e.g. it uses up dressing or bedroom floor space and is awkward-looking and difficult to conceal or design handsomely (FIG. 1).

The other known valet is wall-hanged and consists of a hanger and horizontal bar; wherein the extremes of the bar are connected to the extremes of two transverse bars; the other extreme of said transverse bars being connected in pivoting relation to the top surface of a shelf. The shelf, in turn is attached to a wall. This valet is sometimes concealed within a box attached to the shelf. The disadvantages that this design poses are its large size, which makes it very hard to design aesthetically; users have difficulties to find an adequate hanging place for this valet on walls (FIG. 2).

Both known valets present the further hindrance that hanged trousers tend to slip easily, unless bars are especially fitted with anti-slip wrapping.

SUMMARY OF THE INVENTION

In accordance with the present invention, the disadvantages and problems associated with previous valets have been substantially reduced or eliminated.

A primary object of the invention is to provide a valet constructed as a case which liberates shelf and floor space and either presents an aesthetic appearance or does not at all attract attention.

BRIEF DESCRIPTION OF THE DRAWINGS

For a more complete understanding of the present invention, and the advantages thereof, reference is now made to the following description taken in conjunction with the accompanying drawings in which:

FIG. 7 is a front view of a preferred application of the invention;

FIG. 8 is a lateral right side view of the embodiment shown in FIG. 7;

FIG. 9 is a top view thereof;

DETAILED DESCRIPTION OF THE INVENTION

Figure 1:
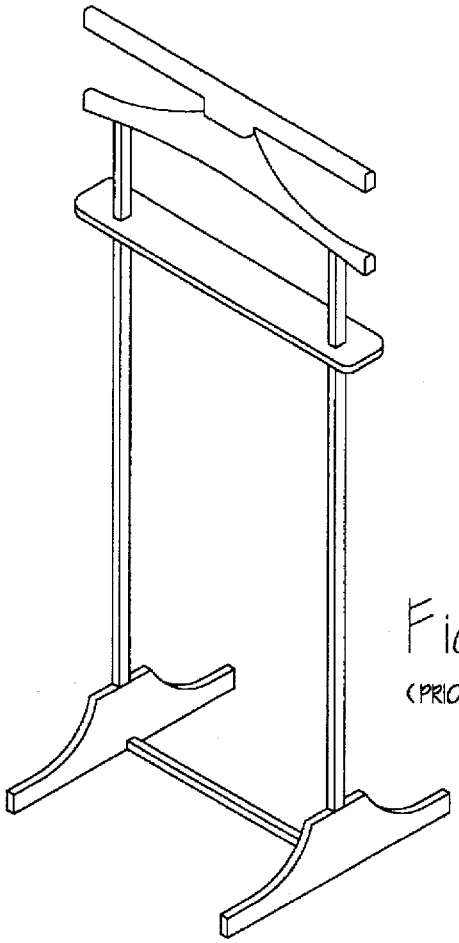
Fig. 1 (PRIOR ART)
FIG. 1 is a schematic perspective drawing of a valet of valet of the prior art.
Figure 2:
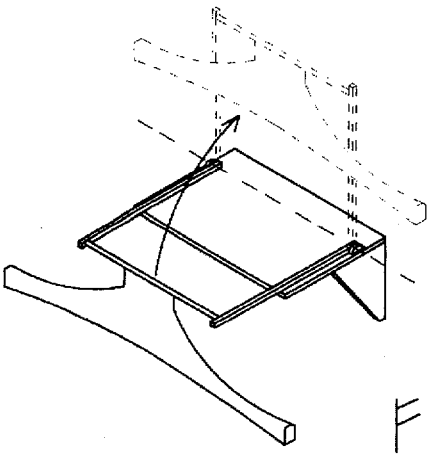
Fig. 2 (PRIOR ART)
FIG. 2 is a schematic perspective drawing of another valet of the prior art.

The preferred embodiments of the present invention and its advantages are best understood by referring to FIGS. 3 through 13 of the drawings, like numerals being used for the like and corresponding parts of the various drawings.

Case (20) carries internal slide bars (21) on the internal face of the side walls (22) to receive in sliding relation the slits (23) in the outside of side walls (24) of the frame supporting structure or drawer (25); thus allowing drawer (25) to slide easily from a closed position (in which drawer (25) lies completely inside of case (20)) to an open position (in which drawer (25) securely rests partially outside case (20)).

Drawer (25) contains hanger (26) which is apt to pivot inside said drawer (25) on an "X" axis located close to the front of the drawer (25); said "X" axis extending perpendicularly from one side wall (24) of drawer (25) to the opposite side wall. Said "X" axis being any adequate rod or tube to which the "head" of the hanger (26) is conveniently attached. The hanger/rod combination is free to pivot from a folded horizontal position inside drawer (25) to a deployed vertical position (FIGS. 10, 11, 12 and 13).

Hanger (26) conveniently provides arms (28) having arm extensions (**28*a*) which are designed to pivot upwardly. The joint between arms (28) and arm extensions (28*a***) being designed so that they can only pivot upwardly, impeding downward pivoting beyond the straight arm line.

Figure 10:
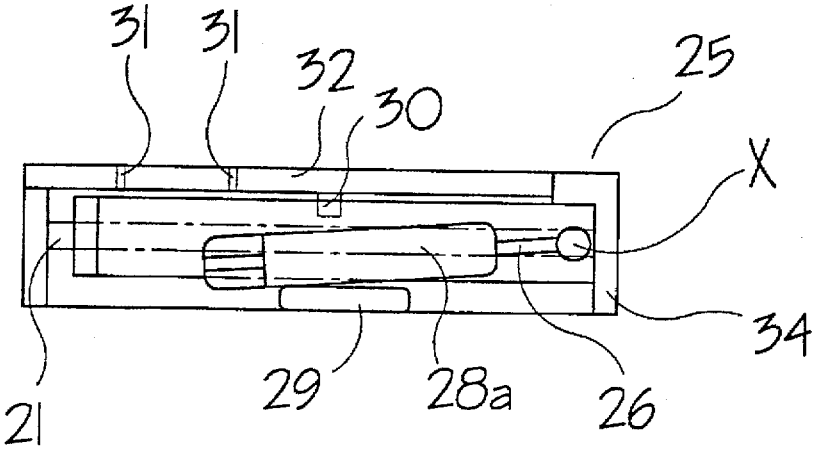
FIG. 10 is a right side view similar to the one illustrated in FIG. 4 with the lateral panel of the housing removed.
Figure 11:
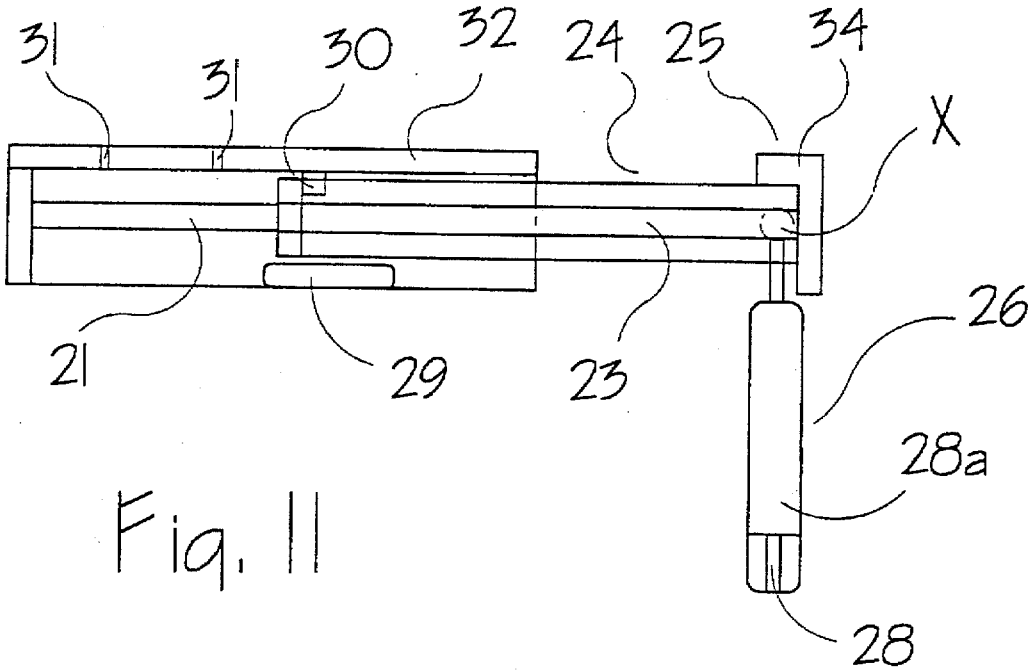
FIG. 11 is a lateral view as FIG. 10 showing the hanger drawer or frame structure in the open position.
Figure 12:
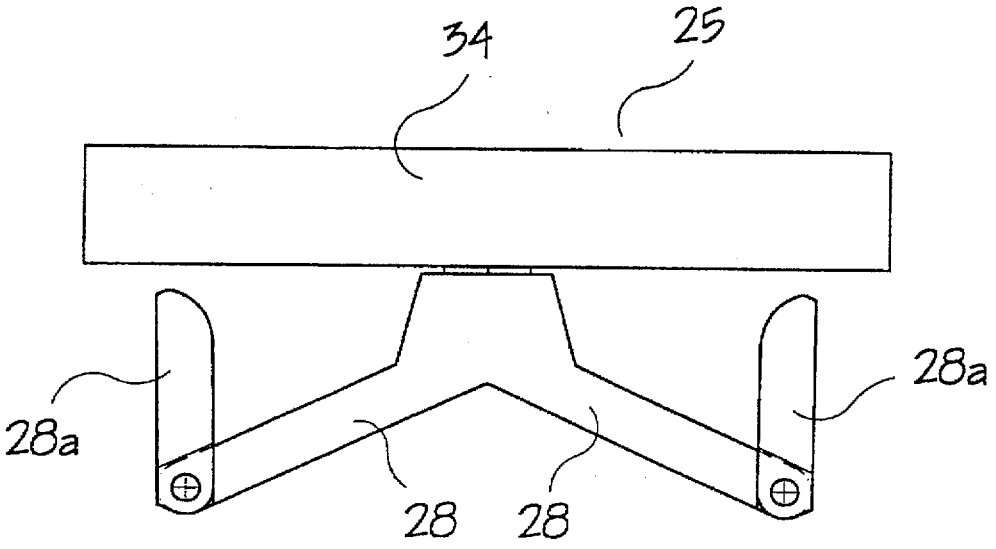
FIG. 12 is a front view of the valet of FIG. 3 in the open position with the hanger in the vertical position and having the arms extensions in folded position.
Figure 13:
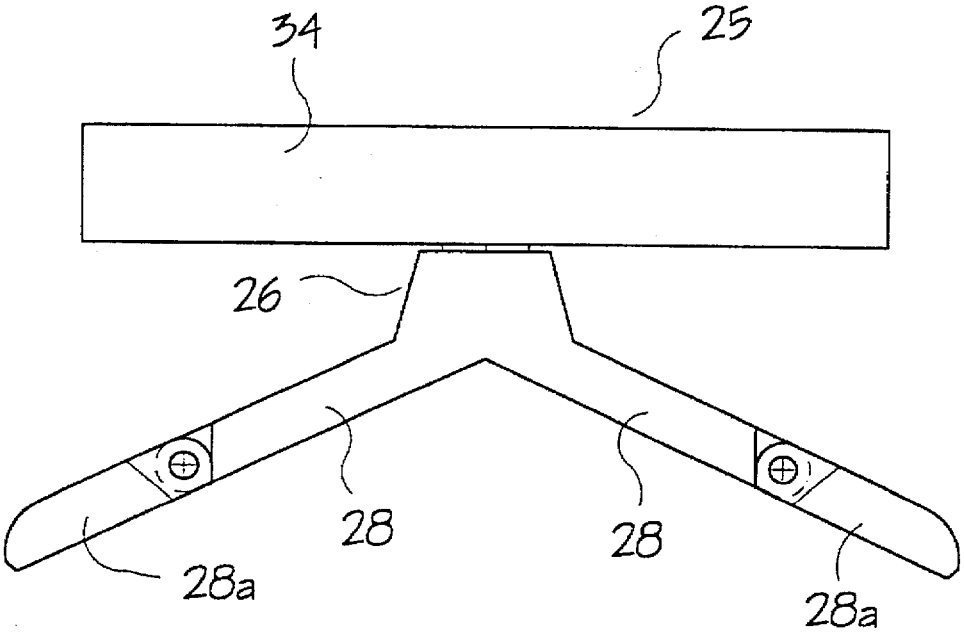
FIG. 13 is a front view of the valet of FIG. 3, similar to that of FIG. 12, in its open position with the hanger in the vertical position and having the arms extensions in its extended position.

Hanger (26), with arm extensions (**28*a*) in the folded position, can pivot up and down around axis X. when pivoted upwardly it fits into drawer (25) and can be slided into case (20), the complete valet assembly looking as shown in FIG. 10, wherein the folded hanger rests on its elbows on a "bridge plate" (29) which acts as bottom of case (20). When pulled open for a next use, drawer (25) will slide out, first dropping the folded hanger (26). Drawer (25) will not continue opening when the back panel contacts catch (30). Said catch (30) can be constructed in any adequate material. The user then unfolds the arm extensions (28*a*) of hanger (26**) and the valet is ready for use.

Trousers are hung over the front plate (34) of drawer (25), and can be pinched, in order to avoid slippage—even if pulled—, between the front plate (34) of drawer (25) and the front of case (20) by pressing drawer (25) against the case (20).

Figure 3:
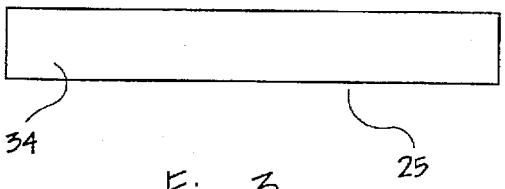
FIG. 3 is a front view of an embodiment of the valet of the present invention.
Figure 4:
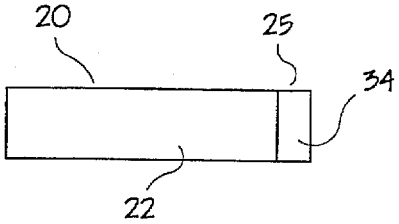
FIG. 4 is a right side view thereof.
Figure 5:
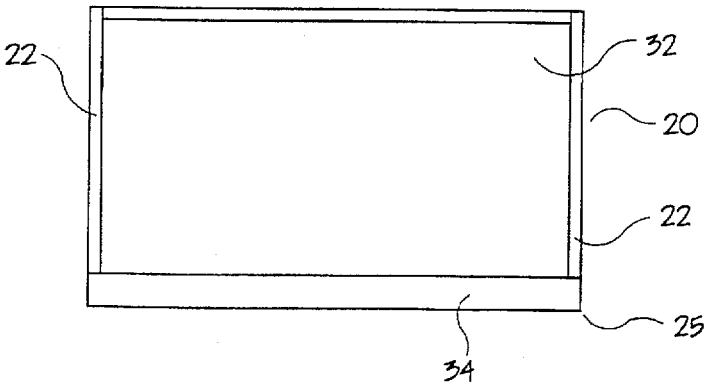
FIG. 5 is a top view thereof.
Figure 6:
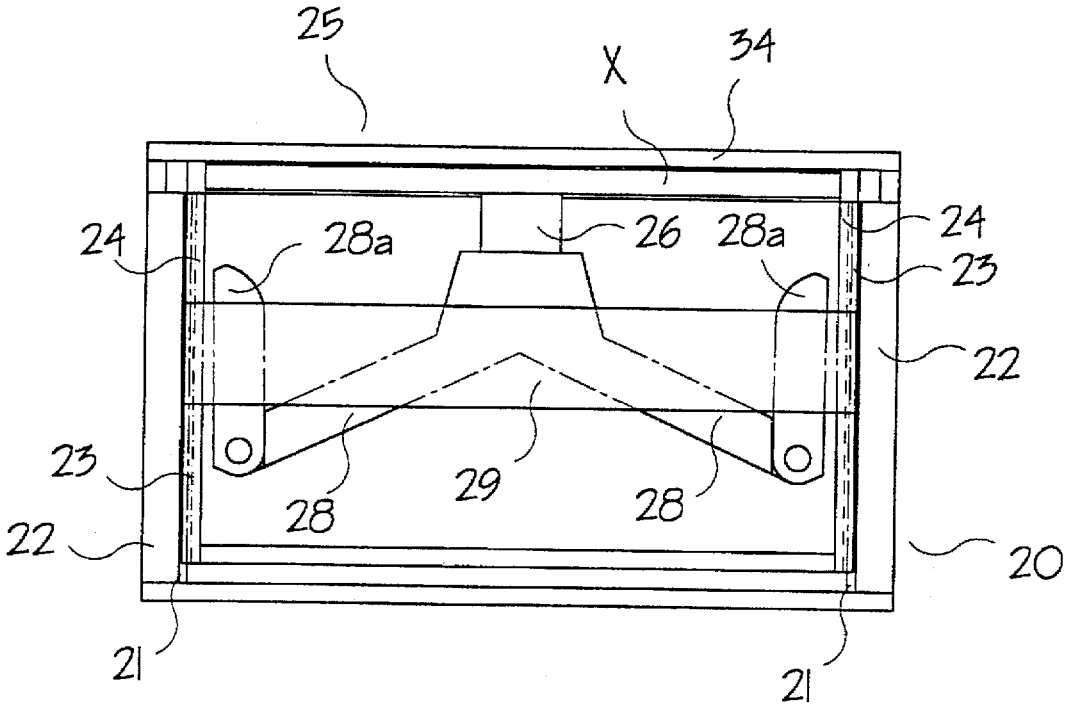
FIG. 6 is a bottom view the thereof.

The embodiment of the valet shown in FIG. 3 is attached to any bottom surface of a shelf or similar, e.g. by means of screws through holes (31) conveniently located in the top plate (32) of case (20). This preferred valet is most useful for being applied to the bottom of any existing shelf, inside or outside a closet, or any other adequate surface providing a space which accepts the reduced height of the valet.

The same embodiment of the valet shown in FIG. 3 may be installed in the upper surface of any shelf or any other piece of furniture, e.g. on the top of cabinet or the similar, if provided with adequate means. In FIG. 8, perforations 36 are shown which allow applying screws to install the valet on the top of an existing piece of furniture or any other adequate surface.

The valet in its closed position will occupy very little space (e.g. 2" height×14½" wide; as seen from the front) in between shelves or other surfaces; the space required for introducing the valet for its installation also being most convenient (approx. 8½" depth). When the hanger is required, the drawer (25) is pulled open and the hanger (26) falls in position to allow the opening of the arm extensions (28*a*) and is ready for use. Closing the valet requires pivoting upwards of the arm extensions (28*a*) and lifting the hanger (26) towards the inside of the drawer (25) in order to allow the same to rest in the bridge plate (29) of the case (20), and closing of the drawer (25).

In FIG. 7 the valet is illustrated installed to a back plate/lateral panels combination (33) which allows the installation of the valet on a wall by attaching the valet by any adequate means, e.g. screws applied through perforations (35), to said combination (33), which in turn is applied against a wall or any adequate vertical surface.

Conveniently, a division (not shown) may be inserted above the rod/hanger combination in such a way as to not disturb normal pivoting of the rod, e.g. a wood plate having the internal dimensions of drawer (25), which will allow placing small objects which are normally kept in the pockets of the clothes to be hanged (like pens, lighter, keys, etc.) inside drawer (25).

From the foregoing description, it will be appreciated that the hanger in accordance with the present invention disappears from sight when folded up and closed inside the case.

Although the present invention and its advantages have been described in detail, it should be understood that various changes, substitutions and alterations can be made therein without departing from the spirit and scope of the invention as defined in the following claims.

I claim:

1. A valet comprising:

a case having an open bottom;

a sliding drawer slidably mounted in said case and having a front face panel for said case and an open bottom;

a hanger pivotally mounted in said drawer for depending downwardly when the drawer is opened by pulling it partially outwardly of said case for hanging clothes thereon and pivotable upwardly for housing the hanger enclosed entirely within the drawer when closed, said front panel being disposed spaced forwardly of the case when the drawer is partially opened and the hanger is depending therefrom for draping trousers or other clothes over the front panel; and said case having a bridging element across the open bottom thereof disposed for supporting the hanger pivoted upwardly slidably resting on said bridging element housed in the drawer for storage when the drawer is closed and disposed for allowing the hanger to slide thereon and depend downwardly when the drawer is opened for hanging clothes therefrom.

2. A valet according to claim 1, in which said hanger is a coat hanger.

3. A valet according to claim 1, including a pivot for said hanger in said drawer.

4. A valet according to claim 1, in which said case has a limit stop internally thereof for limiting the extent the drawer is opened by pulling it, and disposed relative to said bridging element to allow positioning the drawer in said case for said hanger to be pivotable upwardly for storage when the drawer has been opened and is the closed.

5. A valet according to claim 1, in which said case has a stop and sides securable on an underside of a shelf.

6. A valet according to claim 5, in which said shelf is a wall-hung shelf.

7. A valet according to claim 1, including a pivot for said hanger disposed in the drawer toward the front panel.

8. A valet according to claim 7, in which said pivot is a rod.

9. A valet according to claim 8, in which said rod is tubular.

10. A valet according to claim 1, in which said hanger having arms with end portions hereof pivotally mounted on respective arms for pivotal folding towards the arms for storage and pivotal for defining extensions on said arms.

* * * * *